US009517644B2

(12) United States Patent
Kamijo et al.

(10) Patent No.: US 9,517,644 B2
(45) Date of Patent: Dec. 13, 2016

(54) PRINTING APPARATUS

(71) Applicant: Seiko Epson Corporation, Tokyo (JP)

(72) Inventors: Takeho Kamijo, Matsumoto (JP); Takayuki Tamaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/813,627

(22) Filed: Jul. 30, 2015

(65) Prior Publication Data

US 2016/0039222 A1 Feb. 11, 2016

(30) Foreign Application Priority Data

Aug. 8, 2014 (JP) ..... 2014-162228

(51) Int. Cl.

| | |
|---|---|
| ***B41J 11/00*** | (2006.01) |
| ***B41J 11/04*** | (2006.01) |
| ***B41J 11/06*** | (2006.01) |
| *B41J 15/04* | (2006.01) |

(52) U.S. Cl.

CPC ..... *B41J 11/0085* (2013.01); *B41J 11/06* (2013.01); *B41J 15/04* (2013.01)

(58) Field of Classification Search

CPC ..... B41J 11/0085; B41J 11/06; B41J 15/04
See application file for complete search history.

(56) References Cited

U.S. PATENT DOCUMENTS

| | | | | |
|---|---|---|---|---|
| 7,390,085 | B2 | 6/2008 | Ishii et al. | |
| 8,613,514 | B2 | 12/2013 | Ozaki | |
| 2003/0085978 | A1* | 5/2003 | Ishii | B41J 11/0065 347/104 |
| 2007/0291096 | A1* | 12/2007 | Toyoshima | B41J 11/0025 347/104 |
| 2010/0073449 | A1* | 3/2010 | Yamamoto | B41J 11/0085 347/104 |
| 2014/0132691 | A1* | 5/2014 | Ishikawa | B41J 11/06 347/104 |

FOREIGN PATENT DOCUMENTS

| | | | |
|---|---|---|---|
| JP | 2004-268415 | A | 9/2004 |
| JP | 2008-254218 | A | 10/2008 |
| JP | 2009-119778 | A | 6/2009 |
| JP | 4442456 | B2 | 1/2010 |
| JP | 2011-189538 | A | 9/2011 |

* cited by examiner

*Primary Examiner* — Bradley Thies

(57) ABSTRACT

A printing apparatus includes a medium support portion that applies suction to a printing medium and supports the printing medium, a printing unit that prints onto the printing medium supported on the medium support portion, and a transport unit that transports the printing medium supported on the medium support portion. A recessed portion is formed in the medium support portion, and a first suction opening that that applies suction to the printing medium is formed in the recessed portion on a downstream side thereof in a transport direction.

17 Claims, 6 Drawing Sheets

PRINTING APPARATUS

BACKGROUND

1. Technical Field

The present invention relates to printing apparatuses.

2. Related Art

A recording medium transport apparatus having a recording medium transport surface in which a dimple that becomes deeper on a transport downstream side than on a transport upstream side is formed so as to extend from a transport upstream end of a recording medium to a transport downstream end of the recording medium has been known for some time (see JP-A-2004-268415, for example).

However, the stated recording medium transport apparatus has a problem in that a suction force acting on the recording medium becomes weaker on the downstream side of the recording medium in a transport direction thereof, causing the recording medium to lift off of the recording medium transport surface.

SUMMARY

Having been conceived in order to solve at least part of the aforementioned problem(s), as an advantage of the invention, a printing apparatus can be implemented having the following aspects (i.e. embodiments) and/or following the below-described application examples.

Aspect 1

A printing apparatus according to a first aspect of the present invention includes a medium support portion that applies suction to a printing medium and supports the printing medium, a printing unit that prints onto the printing medium supported on the medium support portion, and a transport unit that transports the printing medium supported on the medium support portion in a transport direction. A recessed portion is formed in the medium support portion, and a first suction opening that applies suction to the printing medium is formed in the recessed portion on a downstream side thereof in the transport direction.

According to this configuration, the printing medium receives suction from the first suction opening. Preferably, the first suction opening is located downstream in the recessed portion in the transport direction of the printing medium. Accordingly, lifting of the printing medium from the medium support portion can be suppressed.

Aspect 2

It is preferable that the recessed portion in the printing apparatus include a first region having a first depth and a second region having a second depth that is shallower than the first depth, and that the second region be located downstream from the first region in the transport direction.

According to this configuration, the printing medium that has been printed onto is supported by (e.g. drawn toward by suction to) the second region even in a case where the printing medium has, for example, taken on a wavy shape due to wrinkling or the like. Accordingly, problems in transporting the printing medium can be prevented.

Aspect 3

It is preferable that the first suction opening in the printing apparatus according to the aforementioned aspects be formed in the second region. In this case, it is preferred that no suction openings be formed in the first region. It is further preferred that the recessed portion be formed facing the printing unit.

According to this configuration, the recessed portion provided in the second region on the downstream side of the printing medium in the transport direction makes it possible to apply suction to the transported printing medium from a closer location. Accordingly, the printing medium can be efficiently prevented from lifting.

Aspect 4

In the printing apparatus according to the aforementioned aspects, it is preferable that the first region and the second region be connected by a sloped surface.

According to this configuration, air within the recessed portion is sucked along the sloped surface when the air is drawn out through the suction opening. In other words, a negative pressure can be created within the recessed portion smoothly.

Aspect 5

In the printing apparatus according to the aforementioned aspects, it is preferable that a second suction opening be formed in the medium support portion downstream from the recessed portion in the transport direction.

According to this configuration, the printing medium transported further downstream in the transport direction from the region of the recessed portion also receives suction. Accordingly, the printing medium can be prevented from lifting across a broader area.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
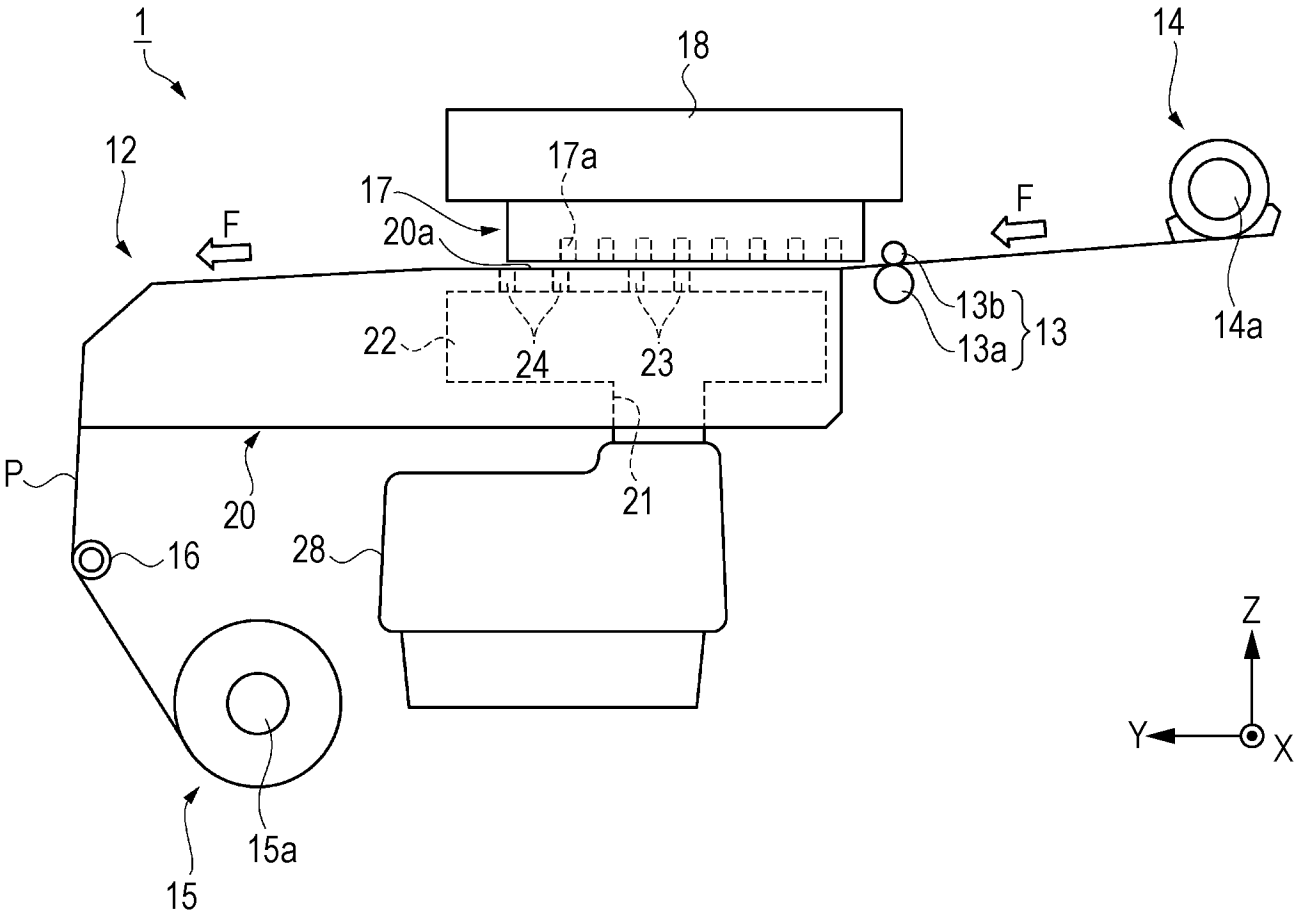
FIG. 1 is a schematic diagram illustrating a configuration of a printing apparatus.

Hereinafter, an embodiment of the invention will be described with reference to the drawings. Note that the appended drawings may depict dimensions of the various members and the like as different from their actual dimensions in order to better illustrate or highlight features of those members and the like.

First, the configuration of a printing apparatus in accord with the present invention will be described with reference to FIG. 1. A preferred printing apparatus 1 includes a medium support portion 20 that applies suction to a printing medium (continuous paper P) and supports the printing medium, a printing unit 17 that prints onto the printing medium, and a transport unit 12 that transports the printing medium supported on the medium support portion 20. A recessed portion (201, see FIGS. 2 and 3) is formed in the medium support portion 20, and a first suction opening 23 that applies suction to the printing medium is formed in (e.g. communicating with) the recessed portion on a downstream side thereof in a transport direction of the printing medium.

The printing apparatus 1 is preferably an ink jet printer, for example. Note that this embodiment describes a printing apparatus that prints onto long, sheet-shaped continuous paper P that serves as the printing medium. This will be described in detail hereinafter.

FIG. 1 is a schematic diagram illustrating a configuration of the preferred printing apparatus 1. The printing apparatus 1 includes transport unit 12 that transports the continuous paper P (e.g. printing medium), and printing unit 17 capable of ejecting (discharging) ink serving as a liquid onto the continuous paper P transported by the transport unit 12, and the like. The printing apparatus 1 also includes a control unit (not shown) that controls the transport unit 12, the printing unit 17, and the like.

The transport unit 12 preferably includes a feed-out unit 14 that feeds out the continuous paper P, and a take-up unit 15 that takes up (e.g. rolls up) the continuous paper P that has been fed out from the feed-out unit 14 and printed onto by the printing unit 17. In FIG. 1, the feed-out unit 14 is disposed in a position corresponding to an upstream side of the continuous paper P in a transport direction F, and the take-up unit 15 is disposed in a position corresponding to a downstream side of the continuous paper P in a transport path of the continuous paper P.

The printing unit 17 is disposed at a position between the feed-out unit 14 and the take-up unit 15 so as to face a transport path of the continuous paper P. The printing unit 17 may be an ink jet head, for example. A plurality of nozzles 17*a* for ejecting ink onto the continuous paper P are formed in a surface of the printing unit 17 opposite the transport path of the continuous paper P. The printing unit 17 is preferably mounted in a carriage 18, and the carriage 18 is provided so as to be capable of moving back and forth in a main scanning direction X that traverses (and is preferably orthogonal to) the transport path of the continuous paper P while supported by a main guide shaft (not shown). The carriage 18 is connected to a driving motor (not shown), and moves back and forth in the main scanning direction X along the main guide shaft by rotational driving applied by the driving motor.

A medium support portion 20 that supports the continuous paper P is disposed in a position facing the transport path of the continuous paper P and at least a portion of printing unit 17. The medium support portion 20 has a closed-ended box-like shape (e.g. a polyhedron having a roughly cuboid shape with roughly quadrangular sides), wherein an upper outer surface side of medium support portion 20 is opposite the printing unit 17, and a lower outer surface side of medium support portion 20 is opposite the upper outer surface side. An opening 21 is formed in the lower outer surface side of the medium support portion 20.

A suction fan 28, which is an example of a suction unit that sucks air from (i.e. applies suction to) an inner cavity 22 of the medium support portion 20, is provided in a lower area of (e.g. underneath) the medium support portion 20 so as to cover the opening 21. A medium support surface 20*a* that supports the continuous paper P during transport is formed on the surface side of the medium support portion 20 opposite the printing unit 17. First suction openings 23 and second suction openings 24 draw the continuous paper P toward the medium support surface 20*a*, and are formed in the medium support portion 20. The first suction openings 23 and the second suction openings 24 communicate with the inner cavity 22 of the medium support portion 20. By rotationally driving the suction fan 28, air is taken in (i.e. drawn out) through opening 21, which functions as an intake port, and a space between the continuous paper P and the medium support portion 20 can be set to a negative pressure by means of the inner cavity 22, the first suction openings 23, and the second suction openings 24. A suction force for applying suction to the continuous paper P and drawing it toward the medium support surface 20*a* is imparted on the continuous paper P as a result. The configuration of the medium support portion 20 will be described in more detail later.

A feed-out shaft 14*a* extending in a width direction of the continuous paper P (an X-axis direction), which is a direction orthogonal to the transport direction F of the continuous paper P, is provided in the feed-out unit 14 so as to be capable of being rotationally driven. The continuous paper P is pre-wound into a roll shape and supported on the feed-out shaft 14*a* so as to be capable of rotating along with the feed-out shaft 14*a*. The continuous paper P is fed out in a downstream direction in the transport path thereof from the feed-out shaft 14*a* upon the feed-out shaft 14*a* being rotationally driven.

A paper feed roller pair 13 that pinches and guides the continuous paper P transported from the feed-out shaft 14*a* to the medium support surface 20*a* is provided downstream from the feed-out shaft 14*a* in the transport direction F of the continuous paper P. The paper feed roller pair 13 is disposed in a position adjacent to the medium support portion 20 in the transport direction F at an upstream end-side of the medium support portion 20 in the transport direction F. The paper feed roller pair 13 has a paper feed roller 13*a* capable of being rotationally driven, and a paper pressure roller 13*b* that moves in response to rotation of the paper feed roller 13*a*. A position where the continuous paper P is pinched between the paper feed roller 13*a* and the paper pressure roller 13*b* is located higher in a +Z direction than the medium support surface 20*a* of the medium support portion 20.

A tension roller 16 for adjusting the tension of a printed region of the continuous paper P is disposed in the transport path of the continuous paper P, downstream from the medium support surface 20*a*. The take-up unit 15 is disposed downstream from the tension roller 16 in the transport path of the continuous paper P.

A take-up shaft 15*a* extending in the width direction X of the continuous paper P is provided in the take-up unit 15 so as to be capable of being rotationally driven. By rotationally driving the take-up shaft 15*a*, the printed continuous paper P transported from the tension roller 16 side can be continually taken up by the take-up shaft 15*a*.

Figure 2:
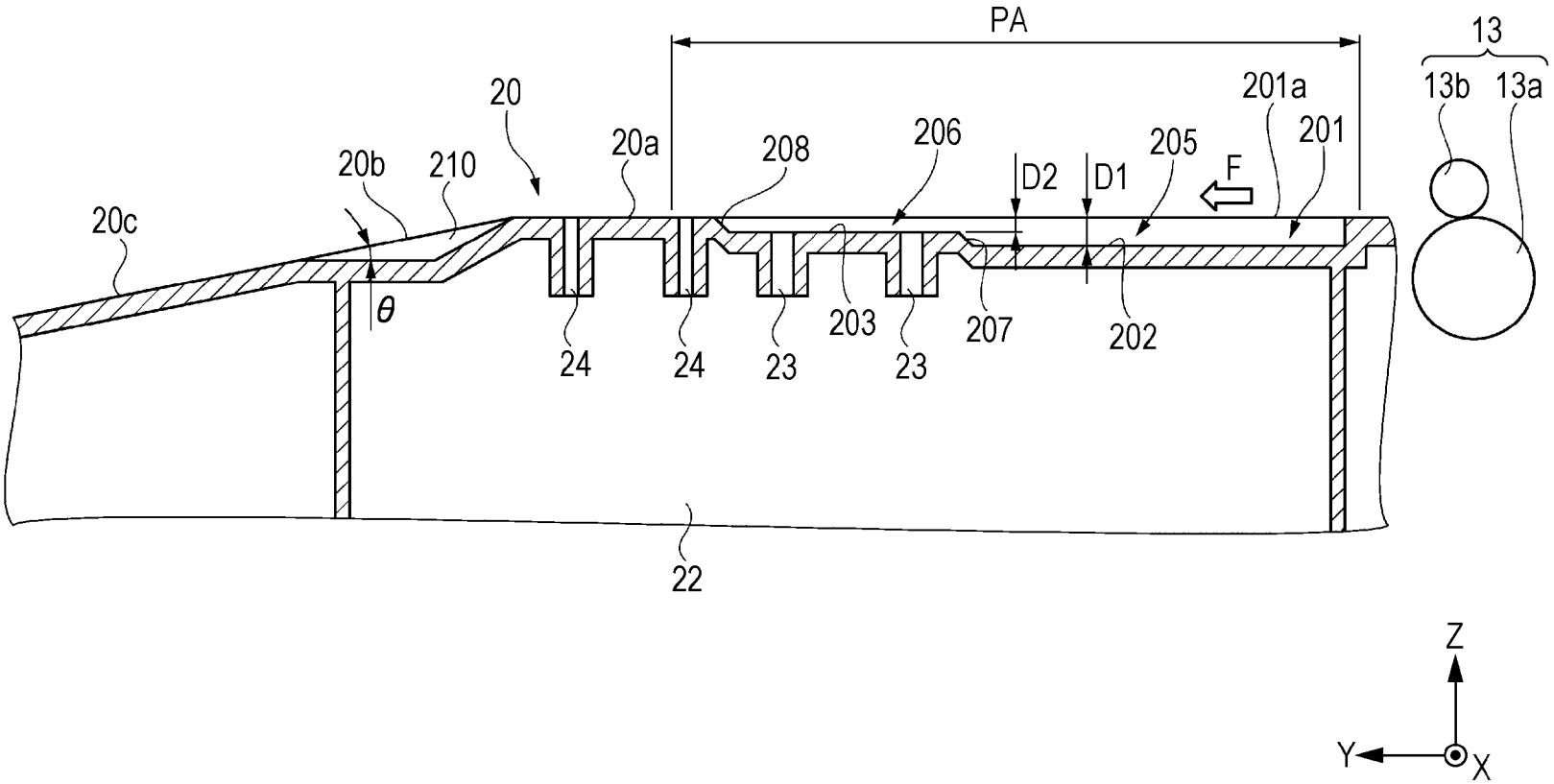
FIG. 2 is a cross-sectional view illustrating a configuration of a medium support portion of the printing apparatus.

Next, the configuration of the medium support portion 20 will be described in detail. FIG. 2 is a cross-sectional view illustrating the configuration of the medium support portion 20, and FIG. 3 is a plan view illustrating the configuration of the medium support portion 20.

Figure 3:
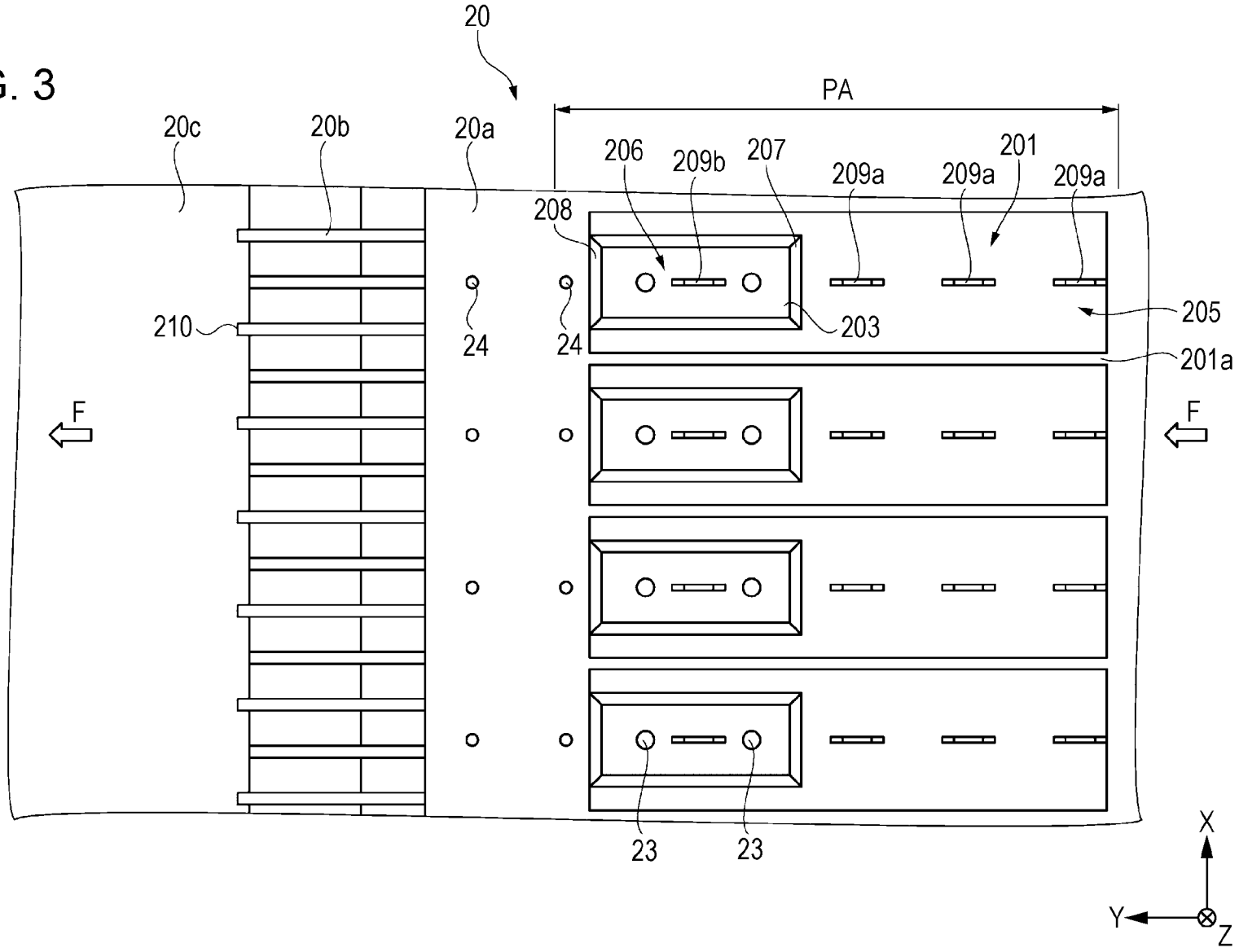
FIG. 3 is a plan view illustrating the configuration of a medium support portion.

As illustrated in FIG. 2 and FIG. 3, recessed portions 201 that are recessed from the medium support surface 20*a* are formed in the medium support portion 20. The recessed portions 201 are partitioned by partition walls 201*a*, and a plurality of the recessed portions 201 are formed in the width direction (the X-axis direction) of the continuous paper P, which is orthogonal to the transport direction of the continuous paper P. The recessed portions 201 are located opposite the printing unit 17 that moves along with the carriage 18. In other words, the recessed portions 201 are formed in positions corresponding to a printing area PA where the printing unit 17 prints onto the continuous paper P. Note that the configuration is such that the medium support surface 20*a* is flush with top faces (e.g. surfaces) of the partition walls 201*a*.

Each of the recessed portions 201 has a first region 205 that is a region having a first depth D1 and a second region 206 that is a region having a second depth D2 lesser (shallower) than the first depth D1, and the second region 206 is positioned downstream from the first region 205 in the transport direction F. Accordingly, even in the case where the continuous paper P that has been printed onto has, for example, taken on a wavy shape due to wrinkling or the like, the continuous paper P is supported by the shallower second region 206 on the downstream side in the transport direction F, which makes it possible to prevent problems from occurring in the transport of the continuous paper P. Note that the dimension of the first depth D1 in the first region 205 is approximately twice the dimension of the second depth D2 in the second region 206.

The first suction openings 23 for applying suction to the continuous paper P are formed in the recessed portions 201. The first suction openings 23 are formed on the downstream side of the recessed portions 201 in the transport direction F. More specifically, the first suction openings 23 are formed in the second regions 206. In this embodiment, two first suction openings 23 are formed in a base surface 203 of each second region 206. The first suction openings 23 communicate with the inner cavity 22 of the medium support portion 20, and by rotationally driving the suction fan 28, the continuous paper P can be drawn by suction toward the medium support portion 20 using the first suction openings 23. Here, a leading end portion of the continuous paper P transported to the printing area PA is prevented from curling by being nipped by the paper feed roller pair 13 in an area of the printing area PA near the paper feed roller pair 13. However without suction, the continuous paper P tends to curl easily at an area of the printing area PA that is far from the paper feed roller pair 13 (on the downstream side in the transport direction F) due to a drop in the effect of the pressurizing force of the paper feed roller pair 13. Accordingly, this embodiment provides the second region 206, in which the first suction openings 23 are located on the downstream side of the printing area PA in the transport direction F and which is comparatively shallow; this makes it possible to apply a suction force to the continuous paper P from a closer location and prevent the continuous paper P from lifting (e.g. curling).

Meanwhile, the first region 205 and the second region 206 are connected by an inter-region sloped surface 207 serving as a sloped surface. Accordingly, when air is sucked (i.e. drawn by suction) through the first suction openings 23, the air within the recessed portions 201 flows along the inter-region sloped surface 207, which makes it possible to put the interior of the recessed portions 201 in a negative pressure state in a smooth manner. Furthermore, the second region 206 and the medium support surface 20*a* downstream from the second region 206 in the transport direction F are connected by a downstream-side sloped surface 208 serving as a sloped surface. The leading end portion of the continuous paper P is therefore transported along the downstream-side sloped surface 208. This makes it possible to prevent problems in transporting the continuous paper P.

Note that in this embodiment, projecting portions 209*a* that project upward in the +Z axis are provided in a base surface 202 of each first region 205 of the corresponding recessed portion 201 (see FIG. 3). The projecting portions 209*a* have essentially the same height as the base surface 203 of the second region 206 when taken from the base surface 202 of the first region 205 (i.e. the upper surface of each projecting portion 209*a* is flush with base surface 203). Furthermore, a projecting portion 209*b* that projects upward in the +Z axis is provided in the base surface 203 of each second region 206 of the corresponding recessed portion 201 (see FIG. 3). Preferably, the projecting portion 209*b* is provided so that a top face of the projecting portion 209*b* is essentially the same height as (i.e. is flush with) the medium support surface 20*a*. Alternatively, the top face of projecting portion 209*b* may be made lower than the medium support surface 20*a*. Providing the projecting portions 209*a* and 209*b* in the recessed portions 201 makes it possible to add supplemental support to the continuous paper P.

A sloped surface 20*b* is formed in the medium support portion 20, downstream from the recessed portions 201 in the transport direction of the continuous paper P. In this embodiment, ribs 210 that follow the transport direction of the continuous paper P are formed in the medium support portion 20 downstream from the recessed portions 201 in the transport direction of the continuous paper P so as to continue from the medium support surface 20*a*, and top faces of the ribs 210 are sloped so as to form the sloped surface 20*b*. The sloped surface 20*b* is formed so as to become lower in a gravitational direction as the surface progresses downstream in the transport direction of the continuous paper P, and an angle θ of the sloped surface 20*b* relative to a horizontal plane is greater than or equal to 10° and less than or equal to 30°. The sloped surface 20*b* is part of a support surface that supports the continuous paper P.

The second suction openings 24 are formed in the medium support portion 20, downstream from the recessed portions 201 in the transport direction F. In this embodiment, the second suction openings 24 are formed between the recessed portions 201 and the sloped surface 20*b*. The second suction openings 24 are formed so as to span from the medium support surface 20*a* to the inner cavity 22. A plurality of the second suction openings 24 are formed along the transport direction F of the continuous paper P. In this embodiment, two of the second suction openings 24 are formed along the transport direction F of the continuous paper P, between a single recessed portion 201 and the corresponding sloped surface 20*b* (see FIG. 2). Meanwhile, a plurality of the second suction openings 24 are formed in the width direction of the continuous paper P (the X-axis direction), which intersects with the transport direction F of the continuous paper P (see FIG. 3). The second suction openings 24 communicate with the inner cavity 22 of the medium support portion 20, and by rotationally driving the suction fan 28, the continuous paper P can be drawn by suction toward the medium support portion 20 using the second suction openings 24.

A downstream-side sloped surface 20*c*, having a less steep angle than the sloped surface 20*b*, is formed downstream from the sloped surface 20*b* in the transport direction F. The downstream-side sloped surface 20*c* is part of the support surface that supports the continuous paper P. Note that no suction openings for applying suction to the continuous paper P are formed downstream from the sloped surface 20*b* in the transport direction F. In other words, the continuous paper P is transported without receiving suction in the area where the downstream-side sloped surface 20*c* is formed. Accordingly, the burden of transporting the continuous paper P is lightened, and problems are prevented from occurring in the transport of the continuous paper P.

Figure 4:
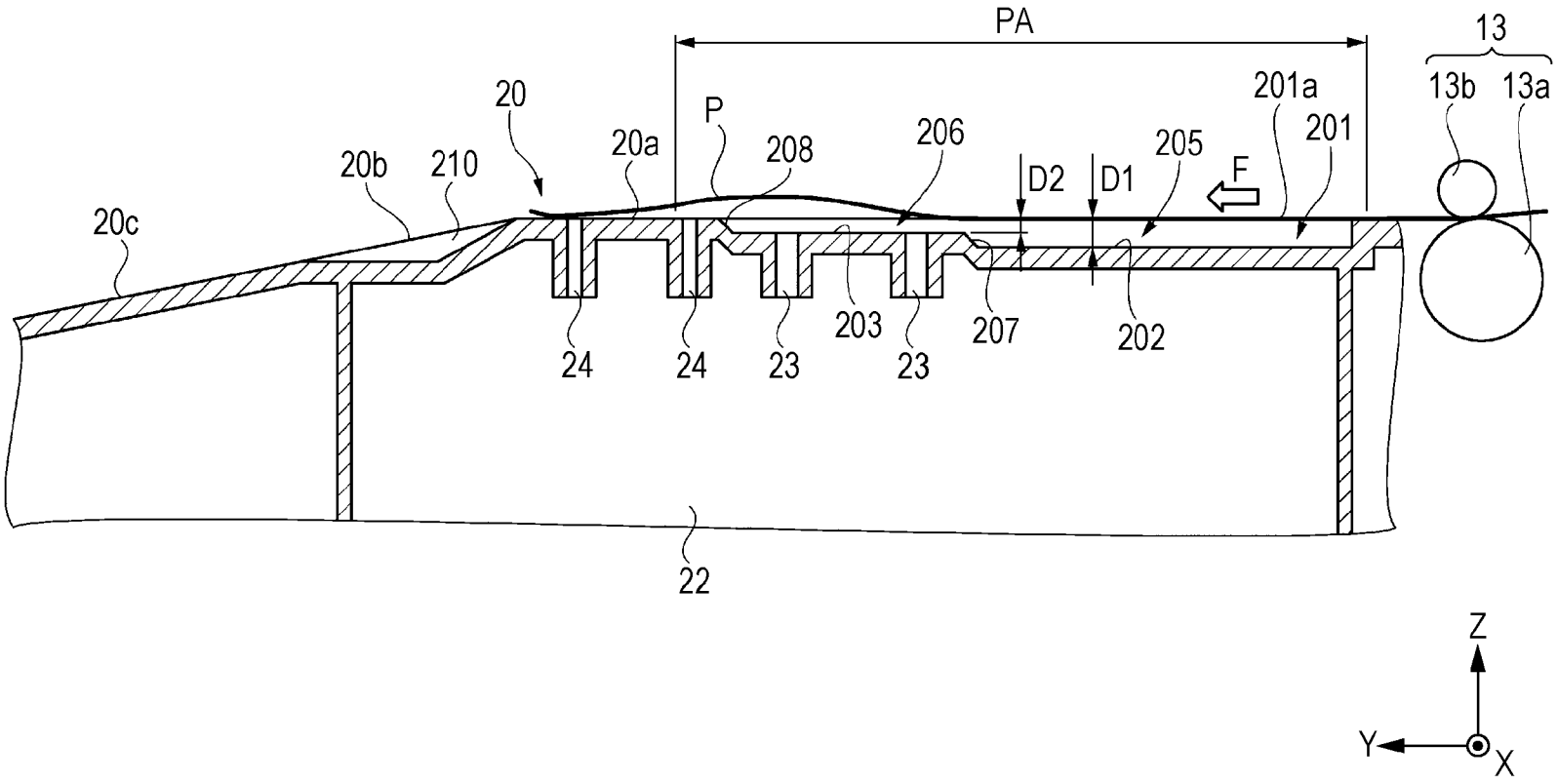
FIG. 4 is a schematic diagram illustrating an operating state of a liquid ejecting apparatus in accord with the present invention.
Figure 5:
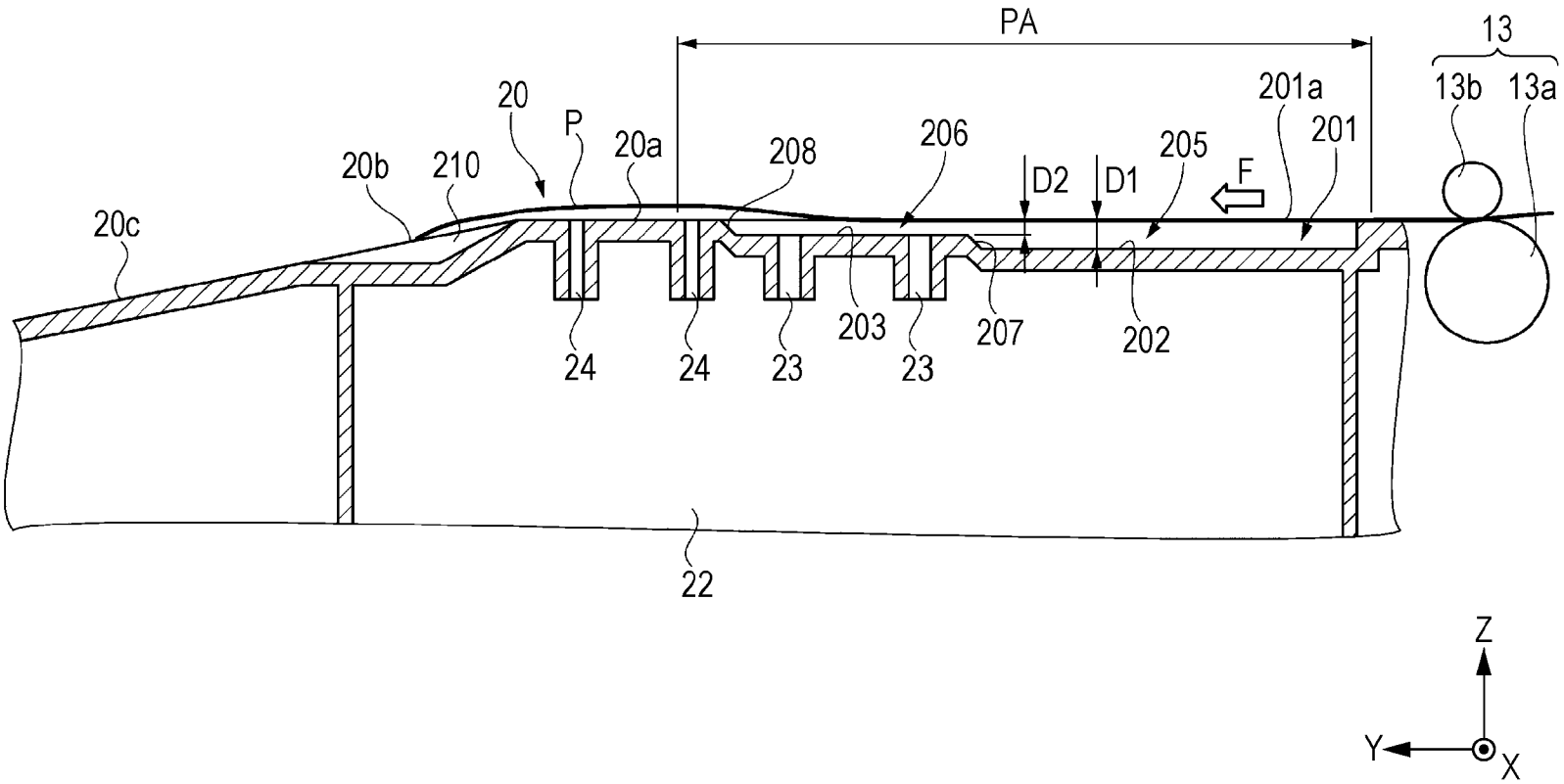
FIG. 5 is a schematic diagram illustrating an operating state of the liquid ejecting apparatus following the operating state of FIG. 4.
Figure 6:
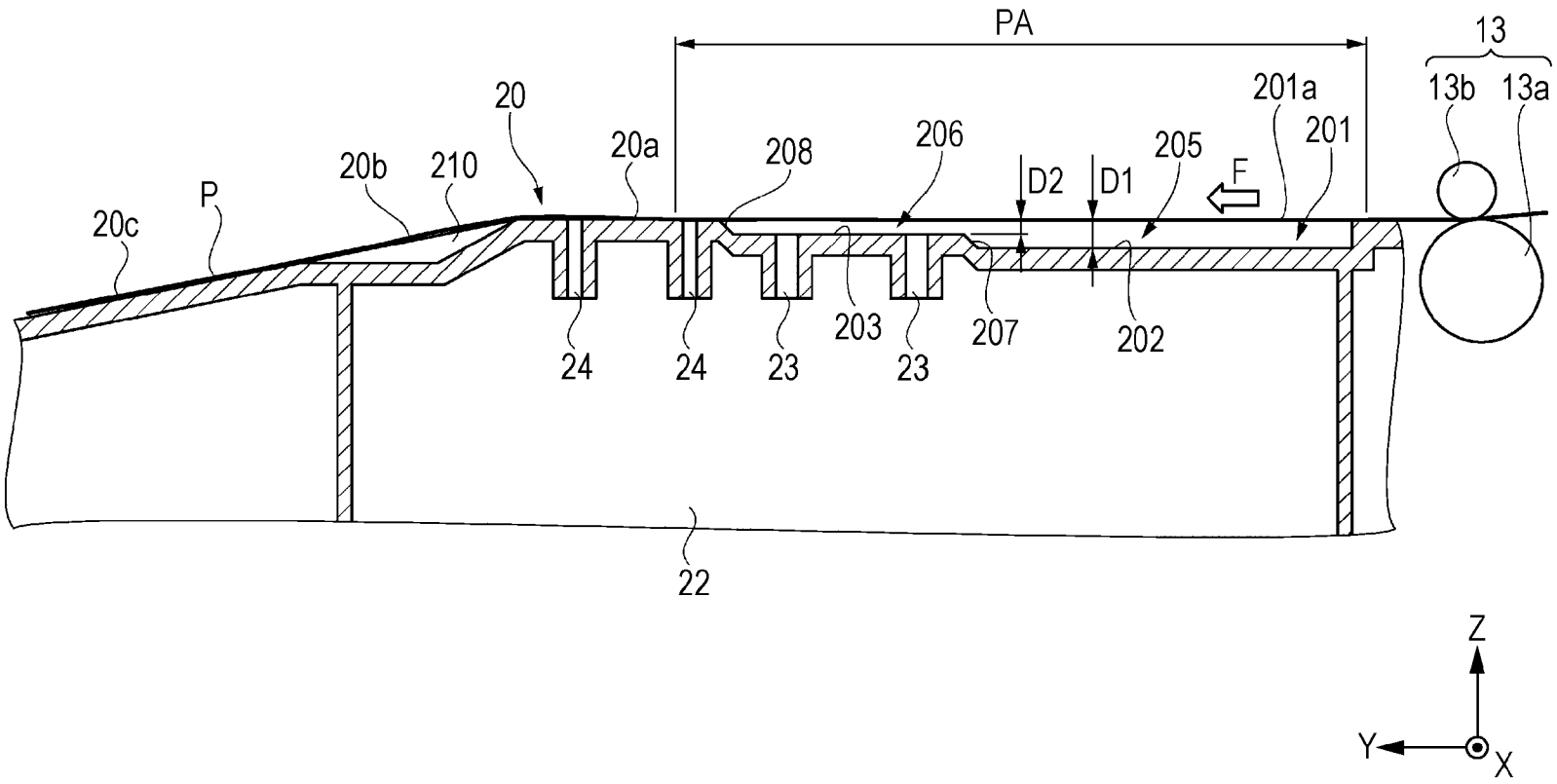
FIG. 6 is a schematic diagram illustrating an operating state of the liquid ejecting apparatus following the operating state of FIG. 5.

Next, a method of operating the printing apparatus will be described. FIG. 4 to FIG. 6 are schematic diagrams illustrating the method of operating the printing apparatus. This embodiment describes a method of operating with respect to the continuous paper P in the printing apparatus 1.

First, the feed-out shaft 14*a* of the feed-out unit 14 is rotationally driven (see FIG. 1). As a result, the continuous paper P is fed out downstream in the transport path thereof from the feed-out shaft 14*a*. The leading end portion of the fed-out continuous paper P is transported into the printing area PA through the paper feed roller pair 13, as illustrated in FIG. 4. The printing unit 17 is then driven while transporting the continuous paper P in the transport direction F. Specifically, ink is ejected from the printing unit 17 while moving the carriage 18 back and forth in the main scanning direction X. As a result, an image is formed on a surface of the continuous paper P. In addition, the suction fan 28 is driven when the continuous paper P is transported to the printing area PA. As a result, in the printing area PA, the continuous paper P is drawn by suction toward the medium support surface 20*a* by means of the first suction openings 23, which suppresses the continuous paper P from lifting. In particular, the opening portions of the first suction openings 23 in the second region 206 provided on the downstream side of the recessed portions 201 in the transport direction F are comparatively close to the continuous paper P and can therefore efficiently apply suction to the leading end portion of the continuous paper P, which makes it possible to suppress lifting of the continuous paper P. In addition, the first region 205 and the second region 206 of the recessed portions 201 are formed with the inter-region sloped surface 207 provided therebetween, which enables the entirety of the recessed portions 201 to be put into a negative-pressure state efficiently.

Furthermore, when the continuous paper P is transported in the transport direction F, the continuous paper P is pulled by suction toward the medium support surface 20*a* by means of the second suction openings 24 and the first suction openings 23, and thus the continuous paper P is prevented from lifting. In particular, the leading end portion of the continuous paper P is suppressed from lifting, and thus the leading end region of the continuous paper P can be printed onto without increasing a margin on the leading end side of the continuous paper P.

Then, the continuous paper P is drawn by suction toward the medium support surface 20*a* by the first suction openings 23 and the second suction openings 24, and the continuous paper P is further transported in the transport direction F while printing. As a result, the leading end portion of the continuous paper P is supported on (makes contact with) the sloped surface 20*b*, as illustrated in FIG. 5. Through this, a force acting in the opposite direction from the direction in which the continuous paper P lifts acts on the continuous paper P at the point where the leading end portion of the continuous paper P makes contact with the sloped surface 20*b*, which acts as a point of support, and the continuous paper P is prevented from lifting in the printing area PA.

Next, the continuous paper P is further transported in the transport direction F. As a result, the continuous paper P is transported while making contact with sloped surface 20*b* on the downstream side, as illustrated in FIG. 6. Here, the sloped surface 20*b* on the downstream side is not provided with a means for applying suction to the continuous paper P, such as a suction opening, and thus the burden of transporting the continuous paper P is lightened, and problems are prevented from occurring in the transport of the continuous paper P.

According to the embodiment described thus far, the following effects can be achieved.

The continuous paper P is receives suction by the first suction openings 23 provided on the downstream side of the recessed portions 201 in the transport direction F of the continuous paper P. Accordingly, the continuous paper P can be prevented from lifting from the medium support surface 20*a*. In particular, lifting of the continuous paper P is reduced with certainty. Consequently, contact, abrasions, and the like between the continuous paper P and the printing unit 17 can be prevented in the printing apparatus 1, particularly in cases where the printing area PA has a comparatively large span (long in the transport direction F).

Note also that the invention is not limited to the embodiment described above, and many variations and alterations thereof are possible as well. Two such variations will be described hereinafter.

Variation 1

Although the aforementioned embodiment describes a configuration that uses long, sheet-shaped continuous paper P that serves as the printing medium, the invention is not limited to this configuration. For example, the configuration may be such that single sheets are used as the printing medium. The same effects as those described above can be achieved even with such a configuration.

Variation 2

Although the aforementioned embodiment describes a configuration of the printing apparatus 1 in which the carriage 18 that moves the printing unit 17 in the main scanning direction (the X-axis direction) is included as an example, the invention is not limited to this configuration. For example, the printing apparatus 1 may be a full line head-type line printer in which a printing unit is provided so as to span the entire width of a print medium in the width direction (the X-axis direction). The same effects as those described above can be achieved even with such a configuration.

The entire disclosure of Japanese Patent Application No. 2014-162228 filed Aug. 8, 2014 is expressly incorporated by reference herein.

What is claimed is:

1. A printing apparatus comprising:

a medium support that applies suction to a printing medium, the medium support having a top surface that supports the printing medium;

a print mechanism that prints within a printing area onto the printing medium supported on the medium support; and a conveyor that conveys the printing medium supported on the medium support in a transport direction;

wherein a cavity is formed in the medium support, the cavity being positioned facing the printing area and receding into the medium support away from the top surface of the medium support, and a first suction opening that applies suction to the printing medium is formed in the cavity, wherein a second suction opening that applies suction to the printing medium is formed in a non-cavity and planar region of the top surface of the medium support, the second suction opening being located downstream from the cavity in the transport direction;

wherein the cavity includes:

a first base floor at a first depth from the top surface of the medium support; and a second base floor at a second depth from the top surface of the medium support, the second depth being smaller than the first depth, and the first base floor and second base floor being offset from each other;

wherein the second base floor is located downstream from the first base floor in the transport direction; and wherein the first suction opening is formed in the second base floor and no suction opening is formed in the first base floor.

2. The printing apparatus according to claim 1, wherein the first base floor and the second base floor are connected to each other by a sloped surface.

3. The printing apparatus according to claim 2, wherein the first base floor and the second base floor are substantially planar surfaces parallel to the planar region of the top surface where the second suction opening is formed.

4. The printing apparatus according to claim 1, wherein no additional suction opening is formed in the medium support downstream from the second suction opening in the transport direction.

5. The printing apparatus according to claim 1, wherein the second suction opening does not face the printing area.

6. The printing apparatus according to claim 1, wherein the first base floor defines a first region of the cavity, the second base floor defines a second region of the cavity, the first and second regions of the cavity are contiguous with each other and in direct air-flow communication with each other.

7. The printing apparatus according to claim 6, wherein no barrier wall separates the first and second regions.

8. The printing apparatus according to claim 7, wherein the first region and second region together constitute the entirety of the cavity.

9. The printing apparatus according to claim 6, wherein the first base floor and the second base floor are planar and directly connected to the each other by a step offset.

10. The printing apparatus according to claim 1, wherein:

the circumference of the cavity is defined by surrounding partition walls, the top of the partition walls being the top surface of the medium support in which the cavity is formed; and the planar region of the top surface of the medium support where the second suction opening is formed is level with the top of the partition walls.

11. The printing apparatus according to claim 1, wherein:

the second suction opening is furthest downstream from all other suction openings along a substantially linear path in the transport direction; and the planar region of the top surface where the second suction opening is formed extends to the cavity.

12. The printing apparatus according to claim 1, wherein the length of the cavity in the transportation direction is wholly encompassed by the printing area.

13. A printing apparatus comprising:

a medium support that applies suction to a printing medium, the medium support having a top surface that supports the printing medium;

a print mechanism that prints within a printing area onto the printing medium supported on the medium support; and a conveyor that conveys the printing medium supported on the medium support in a transport direction;

wherein a cavity is formed in the medium support, the cavity being positioned facing the printing area and receding into the medium support away from the top surface of the medium support, and a first suction opening that applies suction to the printing medium is formed in the cavity;

wherein a second suction opening that applies suction to the printing medium is formed in a non-cavity and planar region of the top surface of the medium support, the second suction opening being located downstream from the cavity in the transport direction;

wherein the cavity includes:

a first region having a first floor at a first depth with respect to the top surface of the medium support; and a second region having a second floor at a second depth that is shallower than the first depth with respect to the top surface of the medium support, the first and second regions being contiguous with each other and being in direct air-flow communication with each other, the second region being connected to the first region by a step offset; and wherein the first suction opening is formed wholly within one of the first region or second region and no suction opening is formed in the other of the first region or second region.

14. The printing apparatus according to claim 13, wherein the step offset is an inclined step.

15. The printing apparatus according to claim 13, wherein no barrier wall obstructs air flow between the first region and the second region.

16. The printing apparatus according to claim 13, wherein the second region is positioned downstream from the first region in the transport direction.

17. The printing apparatus according to claim 13, wherein first floor and second floor are planar and the first depth is substantially twice the second depth.

* * * * *